US005730425A

United States Patent [19]

Brooks

[11] Patent Number: 5,730,425

[45] Date of Patent: Mar. 24, 1998

[54] METHOD AND APPARATUS FOR PAYING OUT, SECURING AND HAULING IN A FLEXIBLE ELONGATE TENSILE MEMBER

[75] Inventor: Derek J. Brooks, Ashby-de-la-Zouch, United Kingdom

[73] Assignee: GEC Alsthom Limited, United Kingdom

[21] Appl. No.: 690,814

[22] Filed: Aug. 1, 1996

[30] Foreign Application Priority Data

Aug. 15, 1995 [GB] United Kingdom ..... 9516730

[51] Int. Cl.[6] ..... B66D 1/00

[52] U.S. Cl. ..... 254/266; 254/389; 114/293

[58] Field of Search ..... 114/293, 199, 114/200, 216, 217, 230; 254/266, 389, 323

[56] References Cited

U.S. PATENT DOCUMENTS

| | | | |
|---|---|---|---|
| 3,638,599 | 2/1972 | Nilsen | 114/200 |
| 4,070,981 | 1/1978 | Guinn et al. . | |
| 4,186,464 | 2/1980 | Sandoy | 114/200 |
| 4,535,973 | 8/1985 | Dorr et al. | 254/323 |
| 4,841,898 | 6/1989 | Ballantyne | 114/293 |
| 5,251,877 | 10/1993 | Rempinski et al. | 254/323 |
| 5,290,014 | 3/1994 | Fergison, Jr. | 254/323 |
| 5,522,336 | 6/1996 | Fujita | 114/293 |

FOREIGN PATENT DOCUMENTS

| | | |
|---|---|---|
| 2 327 137 | 5/1977 | France . |
| 33 36 113 A1 | 4/1985 | Germany . |
| 621540 | 4/1949 | United Kingdom . |
| 1 506 336 | 5/1978 | United Kingdom . |

*Primary Examiner*—Katherine Matecki
*Attorney, Agent, or Firm*—Kirschstein, et al.

[57] ABSTRACT

A mooring system comprises a length of hawser 3, a chafe chain 7, and a wire 5 to be wound onto a rotatable drum 1. Adjacent the drum 1 is positioned a stopper 2 adapted to receive and retain the chain 4, the chain 4 being disconnectable from the wire 5 in this circumstance.

25 Claims, 3 Drawing Sheets

METHOD AND APPARATUS FOR PAYING OUT, SECURING AND HAULING IN A FLEXIBLE ELONGATE TENSILE MEMBER

BACKGROUND TO THE INVENTION

This invention is concerned with an apparatus and a method for paying out, securing and hauling in a flexible elongate tensile member.

The apparatus incorporates a drum onto which the flexible elongate tensile member may be wound and from which the member may be unwound. The arrangement may be utilised in inter alia any winch system or any hoist system in which the tensile member may take the form of a hawser, chain, wire or line or any other like member having a breaking strength consistent with the particular usage to which the system is to be put. The arrangement however, finds particular use in a mooring system where the member is adapted to link two large structures such as a shuttle oil tanker and an oil production unit. In this particular application the member may, and indeed generally will, comprise a plurality of differently formed flexible elongate tensile members joined together to form a continuous length.

In prior art arrangements, a 'fully unwound' condition of the flexible elongate member will, in fact, usually involve the presence of one or more 'dead' turns on the drum. Under these conditions the elongate member may be wound around a bollard or passed through a cleat which takes the load on the member when it is put under strain, but this can involve considerable manual effort and also physical risk to the operator from unwanted and unexpected movement of the member.

The invention seeks to provide an improved arrangement whereby the member may be anchored in a fully unwound condition with the minimum of manual effort.

SUMMARY OF THE INVENTION

According to one aspect of the invention there is provided an apparatus for paying out, securing and hauling in a flexible elongate tensile member, the apparatus comprising a rotatable drum onto which and from which the tensile member can be wound and unwound, respectively, and to which one end of the tensile member is attached, and an anchoring means disposed adjacent to the drum, the apparatus being arranged such that, following a complete paying-out of the member from the drum, the tensile member can be brought into engagement with the anchoring means by a continued rotation of the drum in the same direction as that in which paying-out was effected, the tensile member being then securable to the anchoring means.

In the preferred arrangement the anchoring means is disposed such that, during said continued rotation of the dram and at the point at which the tensile member starts to wind back onto the drum in the opposite sense, the tensile member lies adjacent the anchoring means for securing thereto.

It is further preferred that the anchoring means is disposed such that, during paying-out of the tensile member, said anchoring means lies spaced apart from said tensile member and, during said continued rotation of the drum, said tensile member is caused to approach said anchoring means along a radial plane of the drum.

In an alternative arrangement the anchoring means is positioned below the storage drum.

In either case the anchoring means may be positioned between the drum and a fairlead through which the tensile member is led, and the anchoring means, fairlead and the point at which the tensile member is attached to the drum may lie in a common plane. In such case it is preferred that the axis of the dram is horizontal and the common plane is vertical.

The anchoring means may comprise a receiving member for receiving the tensile member prior to the securing thereof with the receiving member being arranged to allow axial movement of the tensile member therethrough in at least one direction. In addition the receiving member may have guide means to assist entry of the tensile member thereinto.

The anchoring means comprises a stopper in the form of an open topped channel, and the bottom of the said channel itself may have a further channel; the top of the open-topped channel may be closable by a member.

In an alternative arrangement the anchoring means takes the form of a stopper comprising a seating member, the receiving member and seating member being constituted by first and second channel members, respectively, the first channel member being pivotedly seated in the second channel member; the first channel member may be pivotedly seated in the second channel member by way of a load cell.

The anchoring means may comprise a sectoring means for securing the tensile member to the receiving member; the securing means may comprise a sprag, e.g. one or more spragging plates; or a clamp arrangement.

The tensile member may comprise a length of chain and/or a length of wire.

The securing means may be adapted to act on a link of the said chain, e.g. with the sprag acting to wedge a said link against a wall of the anchoring means.

From another aspect the invention provides a method of paying out, securing and hauling in a flexible elongate tensile member, utilising a rotatable drum onto which and from which the tensile member can be wound and unwound, respectively, and an anchoring means disposed adjacent to the drum, said method comprising the steps of rotating the drum to effect complete paying-out of said tensile member from said drum, continuing rotation of said dram in the same direction as that in which paying-out was effected, thereby to bring said tensile member into engagement with said anchoring means, and securing said tensile member to said anchoring means.

BRIEF DESCRIPTION OF THE DRAWINGS

An embodiment of the invention is described by way of example with reference to the accompanying drawings, in which.

DETAILED DESCRIPTION OF THE PREFERRED EMBODIMENTS

The system as described is specifically for use with a mooring line for an oil shuttle tanker and is mounted on an oil production unit positioned at a deep-water location.

Figure 1:
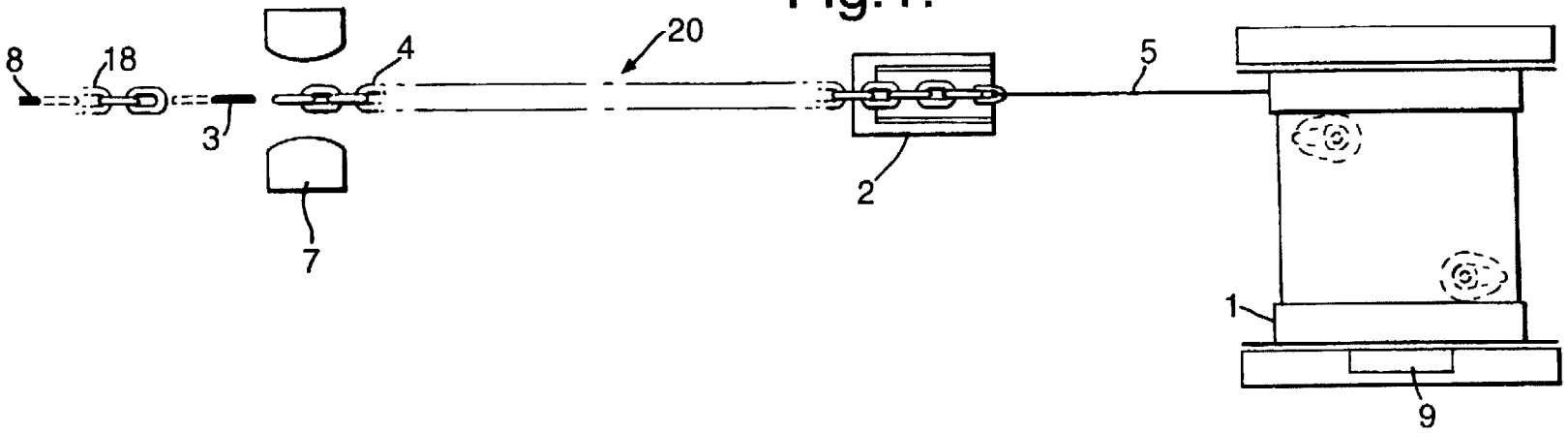
FIG. 1 is a view from above of an apparatus for paying out, securing and hauling in a flexible elongate tensile member with the tensile member shown as fully paid out.
Figure 2:
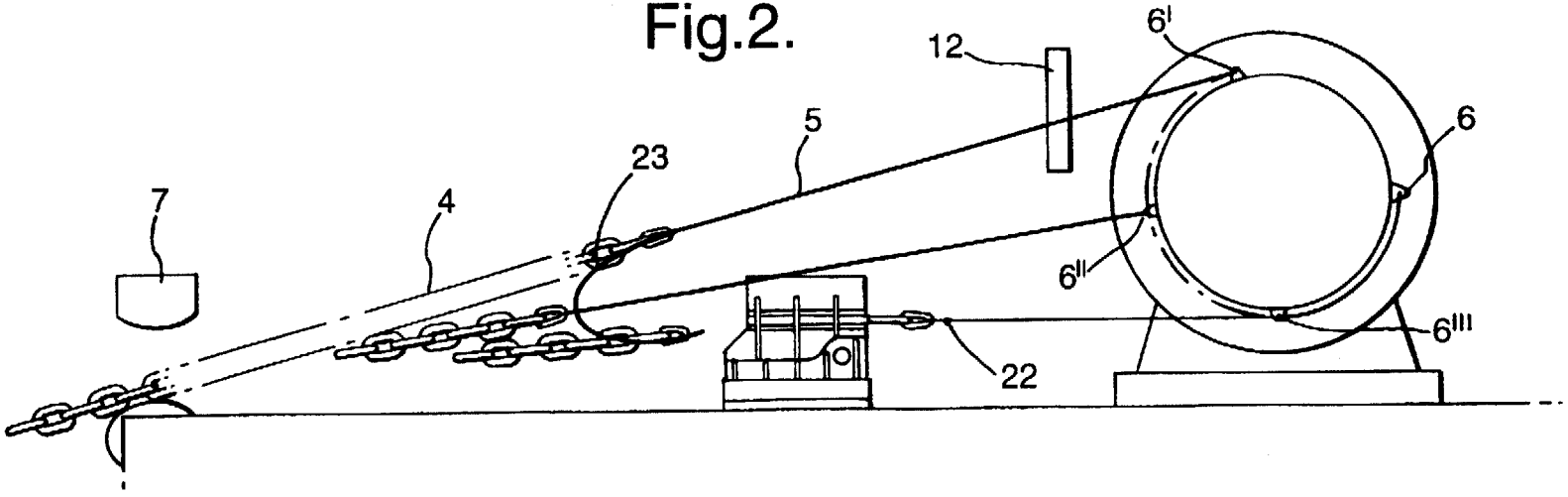
FIG. 2 is a view from one side of the apparatus of FIG. 1.

Referring first to FIGS. 1 & 2, the system comprises a rotatable storage dram 1 mounted on a deck of the oil production unit and onto which is to be wound and from which is to be unwound a flexible elongate tensile member 20. As seen, the member is shown fully paid out from the drum. The member comprises a substantial length of hawser 3 having at one end a length of chain 4 (sometimes referred to as chafe chain) followed by a length of wire or rope 5, and at the other end a further length of chain 18 followed by a length of messenger line 8.

Thus the hawser 3 is terminated by a length of chain 4 having at least the same strength as the hawser, the chain providing a tension member with in-built positive length adjustment i.e. link by link.

The wire 5 is attached to an anchor or connection point, which takes the form of a fastening flange 6 on the curved surface of the drum 1 allowing a degree of pivotal movement of the wire relative to the flange. The wire 5, followed by the chain 4 followed by the hawser 3 and chain 18 and line 8 are wound onto the drum for storage. Such winding on is assisted by a conventional spooling device 12 mounted adjacent the drum 1 and may involve the anchor/connection point 6 being enveloped by the wire 5. Alternatively, it may be appropriate, depending upon the form of the anchor point 6 and/or of the tensile member 20, for the member 20 to be wound onto the drum so as to lie adjacent to but not covering the anchor point 6. Drum rotation may be effected by any form of motor and transmission means. Manual winding is within the ambit of the invention. The messenger line 8 is relatively lightweight but is of sufficient strength to pull hawser 3. It is utilised to make the first connection between the two structures to be connected by the system and is deployed by suitable means, e.g. onto the tanker by a rocket, or, in suitable weather conditions, by small boat.

Thus, in the example envisaged, the messenger line 8 will first be deployed onto a tanker to be moored. The tanker's winch is then operated to wind in the messenger line 8 so unwinding the rest of the messenger line 8, chain 18 and hawser 3 from the storage drum 1, the member 20 running off the top of the rotatable drum 1 tangentially as the drum 1 rotates in one direction, anti-clockwise as seen in FIG. 2.

For motor-driven drums, the motor drive will normally be back-driven during the paying-out procedure in order to provide a braking torque, but a braking arrangement 9 is also provided for further control, including emergency control, of drum rotation as required. The braking arrangement may inter alia be hydraulic, pneumatic or electric.

The arrangement further comprises a fairlead 7, e.g. a set of horizontal and vertical roller guides, and an anchoring means in the form of a stopper 2 disposed adjacent the drum between the drum 1 and the fairlead. For reasons that will become apparent, the flange 6 on the drum, the stopper 2 and the fairlead 7 are mounted in an approximately straight line, in a common vertical plane.

The stopper 2 comprises a first channel shaped member 25 which acts as a receiving member for the tensile member seated in a second channel shaped member 26 with a pivotal interconnection 28 therebetween. Thus the member 25 is pivotably movable relative to the member 26 which itself is rigidly mounted to the aforesaid deck; this allows for changes in direction in the line of action of the hawser. The pivotal interconnection 28 takes the form of a pivot pin which incorporates or constitutes a load cell (see below). The stopper 2 is mounted and arranged to take the full tension of the hawser under load and is rigidly mounted adjacent to but separate from the drum 1, between the fairlead 7 and the drum 1. The stopper 2 is further constructed and mounted such that chain 4 can enter therein by movement of a length of the member 20 adjacent stopper 2, such movement being in a direction substantially transverse to the longitudinal axis of the stopper 2, and in the arrangement illustrated this effectively involves the chain 4 dropping into the stopper. The member 25 comprises a guide way or flat bottomed channel to receive links lying flat, and a narrow channel along the bottom of the channel to receive the alternate links on edge, which construction allows movement of the chain 4 and also the wire 5 axially in either direction therethrough. However, by insertion of sprags (restraining strips) through the side walls of the stopper channel or channels, the chain can be restrained from being pulled axially, in the load direction, through the stopper 2, as will subsequently be explained.

As indicated above, the elongate flexible member 20 leaves the top of the drum tangentially and is paid out through the fairlead 7 which gives controlled deployment and limits the extent of 'off'line load paths which can be followed by the flexible member 20, the motor being back-driven during the process as explained above. During the paying-out process, the member 20 forms a catenary between the top of the drum 1 and the fairlead 7 and the stopper 2 is positioned below this catenary but does not have contact with member 20 and does not interfere with the paying-out process.

Figure 3:
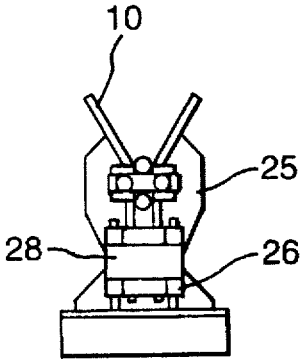
FIGS. 3, 4, 5 show details of the anchoring means of FIGS. 1 and 2, FIG. 3 being an end view from the right, FIG. 4 a plan view and FIG. 5 a sectional view along the median plane.
Figure 4:
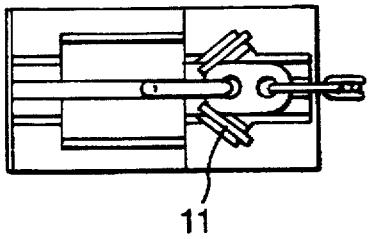
Figure 5:
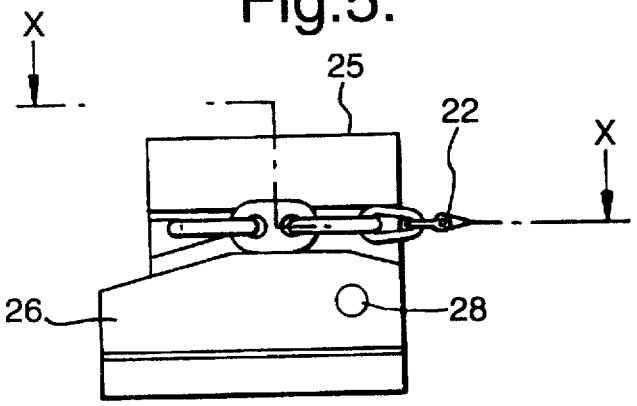

Paying-out is continued with the drum rotating anticlockwise until the hawser, chain and wire rope have been completely wound off the drum, although still attached thereto at flange 6. As the wire becomes unwound, the flange 6 is positioned at the top of the drum at 6', the wire 5 extending above the stopper 2 and the junction of the wire with the chain lying beyond the chain stopper. Anticlockwise rotation of the drum 1 continues and as the flange moves down to 6" and then 6'" the wire 5 moves down with it until it eventually enters the stopper 2. As shown in FIG. 3, the stopper 2 has one or more guide elements 10 angled and arranged to assist such downward movement of wire 5 into the stopper 2.

The connection 22 between wire 5 and chain 4 moves along the locus 23, which lies in a radial plane of the drum, as flange 6 moves from 6' to 6" to 6'". It should be noted that when flange 6 reaches point 6" back-driving of motor is discontinued and the motor is thereafter operated to drive the drum anticlockwise. Hence, as the flange 6 reaches the lowest point 6'" in rotation of the drum the wire 5 will lie in the stopper 2 and, as motor-driven rotation of the drum is continued beyond that point, the wire is pulled axially through the stopper 2 towards the drum 1 to be wound onto the drum 1, again in the reverse direction. After the wire 5 has entered the stopper 2, the top of the channel 25 may be closed off to prevent the wire and subsequently the chain 4 from bursting out of the stopper.

As this process continues, the wire 5 and then the chafe chain 4 are pulled through stopper 2 rightwards as seen in the figures and the chain 4 can then be securely attached by means of an appropriate fastening arrangement or securing means, e.g. by means of a pivoted sprag 11 adapted to wedge a chain link against a side plate of the stopper 2.

In arrangements utilising a pivoted wedge sprag the sprag may be arranged to engage a horizontally inclined link. Alternatively, or in addition, a wedge sprag may engage a vertically inclined link and will in that event be positioned above or below the plane of the adjacent horizontal link.

In an alternative fastening arrangement a clamp is provided to act on one or more links. In normal usage the fastening will involve one or more links adjacent wire 5 and these particular links may be specially constructed to ensure ease of fastening.

With the chain securely fastened in stopper 2, the drum can now be rotated in the opposite, i.e. the clockwise, direction to slacken the wire 5 and with the wire slackened it can then be disconnected from the chain 4.

With the chain fastened in stopper 2 and the wire and chain disconnected from each other as described above, the strain is taken by the stopper 2. Furthermore, and specifically in an emergency situation, the chain can be released from the stopper 2 without any load being put on the drum.

The load cell (see above) acts to monitor the load being put onto the stopper 2 when the chain 4 is fixedly secured thereto. Such a load cell will generally comprise a pin provided with shear planes and within the load cell electronic equipment measures the load applied to the pin from the chain.

When it is desired to wind in the elongate member, the wire is reconnected to the chain and the drum is rotated anticlockwise to remove the load on the sprag 11. The sprag 11 is released in this 'no load' condition, as may be indicated by the load cell on stopper 2. Clockwise rotation of the drum is then commenced, so allowing the chain to be drawn back through the stopper and the wire to rise up out of it as the chain/wire connection moves back up locus 23. Continued clockwise rotation winds in the wire 5, the chain 4 and the hawser 3.

Figure 6:
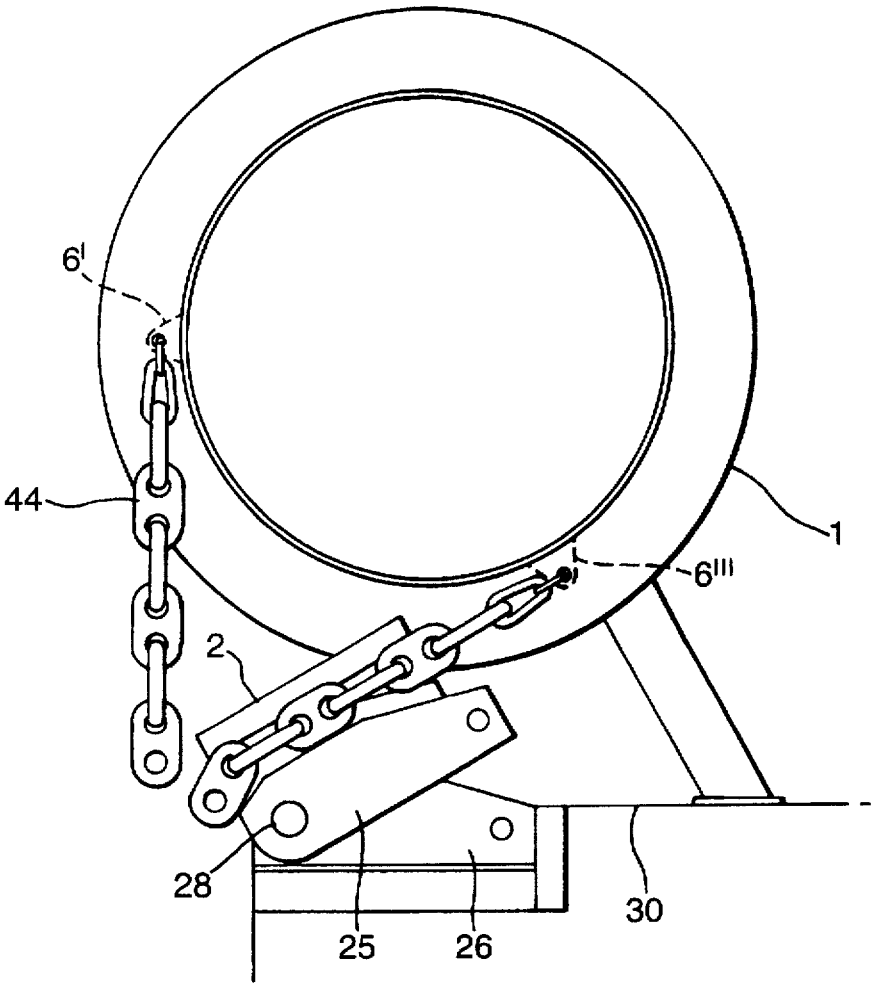
FIG. 6 shows an alternative arrangement wherein the anchoring means is positioned below the storage drum.

In an alternative embodiment, illustrated in FIG. 6, a chain 44 is directly attached to the connection point 6 of the drum 1 although wire 5 of the first embodiment may also be utilised. Further, in FIG. 6, the stopper 2 is disposed below the drum whereby less space is taken up by the apparatus. This may be particularly advantageous in view of the 'clutter' which often exists on the deck of a shuttle tanker. The stopper 2, which as shown utilises a construction with two channel-shaped members 25, 26 as previously described, is received in a recess 30 in the desk surface.

Whilst the wire 5 has been assumed to be attached to the drum by means of a fastening flange 6, this point of connection between the wire and the drum may take the form of a lug or clamp, or any other arrangement, which allows pivoted movement of the wire relative to the drum. Also, seating of the first channel member 25 in the second channel 26 may be by means of a simple pivot pin without the intervention of a load cell.

The stopper 2 may even dispense with a pivoted arrangement altogether and take the form of a rigid, channel-shaped member mounted via a support plinth to a rigid surface, e.g. the deck of an oil production unit.

I claim:

1. An apparatus for paying out, securing and hauling in a flexible elongate tensile member, the apparatus comprising: a rotatable drum onto which and from which the tensile member is wound and unwound, respectively, one end of the tensile member being attached to the drum at a fastening means co-rotatable with the drum; and an anchoring means disposed adjacent to the drum, the drum being rotatable in a first direction such that the tensile member is caused to be paid out from the drum and, following a complete paying out of the tensile member from the drum, continued rotation of the drum in said first direction causes the fastening means to continue to move rotationally in said first direction, the tensile member attached to the fastening means being caused by the continued rotation to move towards the anchoring means until the tensile member engages with the anchoring means, the anchoring means having securing means actuable to secure the tensile member in engagement therewith, the securing memos being alternatively actuable to release the tensile member from engagement with the anchoring means so that, on rotation of the drum in a second direction opposite to said first direction, the tensile member is hauled in and wound onto the drum.

2. The apparatus as claimed in claim 1, in which the anchoring means is disposed such that, during said continued rotation of the drum, the fastening means reaches a rotational position where the tensile member will start to wind back onto the drum, and with the fastening means at that position the tensile member lies adjacent the anchoring means.

3. The apparatus as claimed in claim 1, in which the anchoring means is disposed such that, during paying out of the tensile member, said anchoring means lies spaced apart from said tensile member and, during said continued rotation of the drum, said tensile member is caused to approach said anchoring means along a radial plane of the drum.

4. The apparatus as claimed in claim 1, wherein the anchoring means is positioned below the drum.

5. The apparatus as claimed in claim 1; and further comprising a fairlead through which the tensile member is led, the anchoring means being positioned between the drum and the fairlead.

6. The apparatus as claimed in claim 5, wherein the anchoring means, fairlead and fastening means lie in a common plane.

7. The apparatus as claimed in claim 6, wherein the drum has a horizontal axis, and said common plane is vertical.

8. The apparatus as claimed in claim 1, wherein the anchoring means comprises a receiving member for receiving the tensile member prior to the securing thereof by the securing means.

9. The apparatus as claimed in claim 8, wherein the receiving member is arranged to allow axial movement of the tensile member therethrough in at least one direction.

10. The apparatus as claimed in claim 9, wherein the receiving member has guide means to assist entry of the tensile member thereinto.

11. The apparatus as claimed in claim 1, wherein the anchoring means comprises a stopper, and the stopper comprises an open-topped channel.

12. The apparatus as claimed in claim 11, wherein said channel has a bottom, and wherein the bottom of said channel itself has formed therein a further channel.

13. The apparatus as claimed in claim 12; and further comprising a member adapted to close the top of the open-topped channel.

14. The apparatus as claimed in claim 1, wherein the anchoring means comprises a stopper comprising a seating member and a receiving member, the receiving member and seating member being constituted by first and second channel members, respectively, the first channel member being pivotably seated in the second channel member.

15. The apparatus as claimed in claim 14, wherein the first channel member is pivotably seated in the second channel member by way of a load cell.

16. The apparatus as claimed in claim 1, wherein the securing means is a sprag.

17. The apparatus as claimed in claim 16, wherein the sprag comprises at least one spragging plate.

18. The apparatus as claimed in claim 16, wherein the tensile member comprises a length of chain, and wherein the sprag acts to wedge a link of said chain against a wall of the anchoring means.

19. The apparatus as claimed in claim 1, wherein the securing means is a clamp arrangement.

20. The apparatus as claimed in claim 1, wherein the tensile member comprises a length of chain.

21. The apparatus as claimed in claim 20, wherein the securing means is adapted to act on a link of said chain.

22. The apparatus as claimed in claim 1, wherein the tensile member comprises a length of wire.

23. A mooring system, comprising: an apparatus for paying out, securing and hauling in a flexible elongate tensile member, the apparatus including a rotatable drum onto which and from which the tensile member is wound and unwound, respectively, one end of the tensile member being attached to the drum at a fastening means co-rotatable with the drum, the apparatus further including an anchoring means disposed adjacent to the drum, the drum being rotatable in a first direction such that the tensile member is caused to be paid out from the drum and, following a complete paying out of the flexible member from the drum, continued rotation of the drum in said first direction causes the fastening means to continue to move rotationally in said first direction, the tensile member attached to the fastening means being caused by the continued rotation to move towards the anchoring means until the tensile member engages with the anchoring means, the anchoring means having securing means actuable to secure the tensile member in engagement therewith, the securing means being alternatively actuable to release the tensile member from engagement with the anchoring means so that, on rotation of the drum in a second direction opposite to said first direction, the tensile member is hauled in and wound onto the drum.

24. A method of paying out, securing and hauling in a flexible elongate tensile member, by utilizing a rotatable drum having a fastening means to which the tensile member is attached and onto which drum and from which drum the tensile member is wound and unwound, respectively, and an anchoring means being disposed adjacent to the drum for receiving the tensile member, said method comprising the steps of: rotating the drum in a first direction to effect complete paying out of said tensile member from said drum; continuing rotation of said drum in said first direction as that in which paying out was effected, thereby to move said tensile member towards the anchoring means until the tensile member engages with said anchoring means; thereafter actuating a securing means to secure said tensile member to said anchoring means, and subsequently actuating the securing means to release the tensile member; and rotating the drum in a second direction opposite to said first direction to wind the tensile member onto the drum and thereby haul it in.

25. An apparatus for paying out, securing and hauling in a flexible elongate tensile member, the apparatus comprising: a rotatable drum onto which and from which the tensile member is wound and unwound, respectively, the drum at a peripheral point thereof being provided with an attachment means by means of which one end of the tensile member is attached to the drum; a guiding means for guiding movement of said tensile member during operation of said apparatus; and an anchoring means disposed adjacent to the drum intermediate said guiding means and said drum, said peripheral attachment point, guiding means and anchoring means lying in a substantially straight line when said drum occupies a rotational position at which the tensile member, having been fully paid out from the drum, begins to be rewound onto the drum, said tensile member being then in engagement with said anchoring means, said anchoring means having a securing means which, in use, is selectively actuated between a secured state in which the tensile member is secured when said tensile member is in engagement with the anchoring means, and a released state in which the tensile member is released from engagement with the anchoring means when said tensile member is to be hauled in.

* * * * *